US009784123B2

(12) United States Patent
Morgan et al.

(10) Patent No.: US 9,784,123 B2
(45) Date of Patent: Oct. 10, 2017

(54) TURBINE COMPONENTS WITH BI-MATERIAL ADAPTIVE COOLING PATHWAYS

(71) Applicant: General Electric Company, Schenectady, NY (US)

(72) Inventors: Victor John Morgan, Simpsonville, SC (US); Joseph Fagan, Brookline, MA (US)

(73) Assignee: Genearl Electric Company, Schenectady, NY (US)

( * ) Notice: Subject to any disclaimer, the term of this patent is extended or adjusted under 35 U.S.C. 154(b) by 616 days.

(21) Appl. No.: 14/151,859

(22) Filed: Jan. 10, 2014

(65) Prior Publication Data

US 2015/0198062 A1 Jul. 16, 2015

(51) Int. Cl.

*F01D 5/18* (2006.01)
*F01D 25/12* (2006.01)
*F01D 5/20* (2006.01)

(52) U.S. Cl.

CPC ..... *F01D 25/12* (2013.01); *F01D 5/186* (2013.01); *F01D 5/20* (2013.01); *F05D 2300/50212* (2013.01)

(58) Field of Classification Search

CPC . F01D 5/186; F01D 5/187; F01D 5/18; F01D 25/12; F01D 9/065; F01D 19/02; F01D 21/12; F05D 2260/20; F05D 2260/202; F05D 2300/50212

USPC ..... 415/9, 12, 47, 49, 115; 416/2, 39, 95, 416/96 R, 96 A, 97 R

See application file for complete search history.

(56) References Cited

U.S. PATENT DOCUMENTS

| | | | | |
|---|---|---|---|---|
| 3,626,568 | A * | 12/1971 | Silverstein | B23P 15/04 29/402.16 |
| 5,726,348 | A | 3/1998 | Draghi et al. | |
| 6,265,022 | B1 | 7/2001 | Fernihough et al. | |
| 6,454,156 | B1 * | 9/2002 | Taras, Jr. | B23K 20/16 228/119 |
| 7,241,107 | B2 | 7/2007 | Spanks, Jr. et al. | |
| 7,772,314 | B2 | 8/2010 | Fernihough et al. | |
| 2004/0226682 | A1 * | 11/2004 | Ehrhard | F01D 5/18 165/11.1 |
| 2007/0036942 | A1 | 2/2007 | Steele | |
| 2007/0253815 | A1 * | 11/2007 | Kopmels | F01D 5/18 416/97 R |
| 2010/0239409 | A1 * | 9/2010 | Draper | F01D 5/005 415/1 |
| 2011/0097188 | A1 | 4/2011 | Bunker | |
| 2011/0189015 | A1 | 8/2011 | Shepherd | |

(Continued)

OTHER PUBLICATIONS

Cotronics Corporation; Title: "RESBOND 907GF" 2350 degrees Adhesive & Sealant, date: unknown; p. 1.

(Continued)

*Primary Examiner* — Christopher Verdier
(74) *Attorney, Agent, or Firm* — Eversheds Sutherland (US) LLP

(57) ABSTRACT

A turbine component for use in a hot gas path of a gas turbine engine. The turbine component may include an outer surface, an internal cooling circuit, an adaptive cooling pathway in communication with the internal cooling circuit and extending through the outer surface, and a cooling plug having two or more materials positioned within the adaptive cooling pathway.

2 Claims, 3 Drawing Sheets

(56) References Cited

U.S. PATENT DOCUMENTS

| | | | | |
|---|---|---|---|---|
| 2011/0241297 | A1 | 10/2011 | Morgan et al. | |
| 2012/0183412 | A1 | 7/2012 | Lacy et al. | |
| 2012/0189435 | A1 | 7/2012 | Morgan et al. | |
| 2013/0052036 | A1* | 2/2013 | Smith | F01D 5/188 416/97 R |
| 2013/0078110 | A1* | 3/2013 | Boyer | F01D 5/186 416/97 R |
| 2013/0104517 | A1 | 5/2013 | Correia et al. | |
| 2013/0230394 | A1* | 9/2013 | Ellis | F01D 5/187 416/1 |
| 2014/0099183 | A1* | 4/2014 | Morgan | F01D 5/18 415/1 |

OTHER PUBLICATIONS

Title: High Temperature Ceramic-metallic Pastes; Technical Bulletin A3, Dated Jun. 2012, by Aremco Products, Inc.

* cited by examiner

TURBINE COMPONENTS WITH BI-MATERIAL ADAPTIVE COOLING PATHWAYS

GOVERNMENT INTEREST

This invention was made with Government support under grant number W911W6-11-2-0009 awarded by the Department of Defense. The Government has certain rights in the invention.

TECHNICAL FIELD

The present application and the resultant patent relate generally to gas turbine engines and more particularly relate to gas turbine engines with bi-material adaptive cooling pathways filled with two or more materials with different melting points such that at least one material may release above a predetermined temperature so as to provide a supplemental cooling flow therethrough.

BACKGROUND OF THE INVENTION

Generally described, a gas turbine includes a number of stages with buckets extending outwardly from a supporting rotor disk. Each bucket includes an airfoil over which the hot combustion gases flow. The airfoil must be cooled to withstand the high temperatures produced by the combustion gases. Insufficient cooling may result in undo stress and oxidation on the airfoil and may lead to fatigue and/or damage. The airfoil thus is generally hollow with one or more internal cooling flow circuits leading to a number of cooling holes and the like. Cooling air is discharged through the cooling holes to provide film cooling to the outer surface of the airfoil. Other types of hot gas path components and other types of turbine components may be cooled in a similar fashion.

Although many models and simulations may be performed before a given component is put into operation in the field, the exact temperatures to which a component or any area thereof may reach may vary greatly due to component specific hot and cold locations. Specifically, the component may have temperature dependent properties that may be adversely affected by overheating. As a result, many turbine components may be overcooled to compensate for localized hot spots that may develop on the components. Such excessive overcooling, however, may have a negative impact on overall gas turbine engine output and efficiency.

There is thus a desire for improved designs for airfoils and other types of hot gas path turbine components. Such improved designs may accommodate localized hot spots with a minimized amount of supplemental cooling air. Such improved designs also may promote extended component lifetime without compromising overall gas turbine efficiency and output.

SUMMARY OF THE INVENTION

The present application and the resultant patent thus provide a turbine component for use in a hot gas path of a gas turbine engine. The turbine component may include an outer surface, an internal cooling circuit, an adaptive cooling pathway in communication with the internal cooling circuit and extending through the outer surface, and a cooling plug having two or more materials positioned within the adaptive cooling pathway. The cooling plug may release to provide a cooling medium therethrough when a localized predetermined temperature is reached.

The present application and the resultant patent further provide a method of cooling a turbine component operating in a hot gas path. The method may include the steps of positioning an adaptive cooling pathway in an outer surface of the turbine component, positioning a multi-material cooling plug in the adaptive cooling pathway, releasing the multi-material cooling plug if a predetermined temperature of an outer material of the multi-material cooling plug is reached or exceeded, and flowing a cooling medium through the adaptive cooling pathway to cool at least a localized portion of the outer surface.

The present application and the resultant patent further provide a hot gas path component for use in a hot gas path of a gas turbine engine. The airfoil component may include an outer surface, an internal cooling circuit, a cooling pathway in communication with the internal cooling circuit and extending through the outer surface, an adaptive cooling pathway in communication with the internal cooling circuit and extending through the outer surface, and a bi-material cooling plug positioned within the adaptive cooling pathway. The bi-material cooling plug may include a lower temperature outer material and a higher temperature inner material. The bi-material cooling plug may release to provide a cooling medium therethrough when a localized predetermined temperature is reached.

These and other features and improvements of the present application and the resultant patent will become apparent to one of ordinary skill in the art upon review of the following detailed description when taken in conjunction with the several drawings and the appended claims.

DETAILED DESCRIPTION

Figure 1:
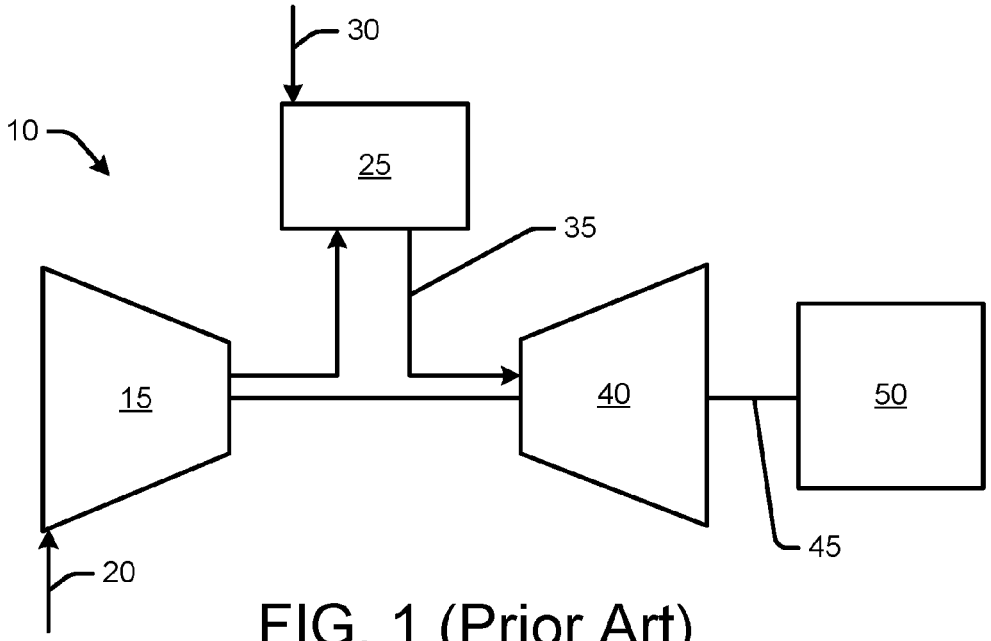
FIG. 1 (Prior Art)
FIG. 1 is a schematic diagram of a gas turbine engine showing a compressor, a combustor, and a turbine.

Referring now to the drawings, in which like numerals refer to like elements throughout the several views, FIG. 1 shows a schematic view of gas turbine engine 10 as may be used herein. The gas turbine engine 10 may include a compressor 15. The compressor 15 compresses an incoming flow of air 20. The compressor 15 delivers the compressed flow of air 20 to a combustor 25. The combustor 25 mixes the compressed flow of air 20 with a pressurized flow of fuel 30 and ignites the mixture to create a flow of combustion gases 35. Although only a single combustor 25 is shown, the gas turbine engine 10 may include any number of combustors 25. The flow of combustion gases 35 is in turn delivered to a turbine 40. The flow of combustion gases 35 drives the turbine 40 so as to produce mechanical work. The mechanical work produced in the turbine 40 drives the compressor 15 via a shaft 45 and an external load 50 such as an electrical generator and the like.

The gas turbine engine 10 may use natural gas, liquid fuels, various types of syngas, and/or other types of fuels and blends thereof. The gas turbine engine 10 may be any one of a number of different gas turbine engines offered by General Electric Company of Schenectady, N.Y. and the like. The gas turbine engine 10 may have different configurations and may use other types of components. Other types of gas turbine engines also may be used herein. Multiple gas turbine engines, other types of turbines, and other types of power generation equipment also may be used herein together.

Figure 2:
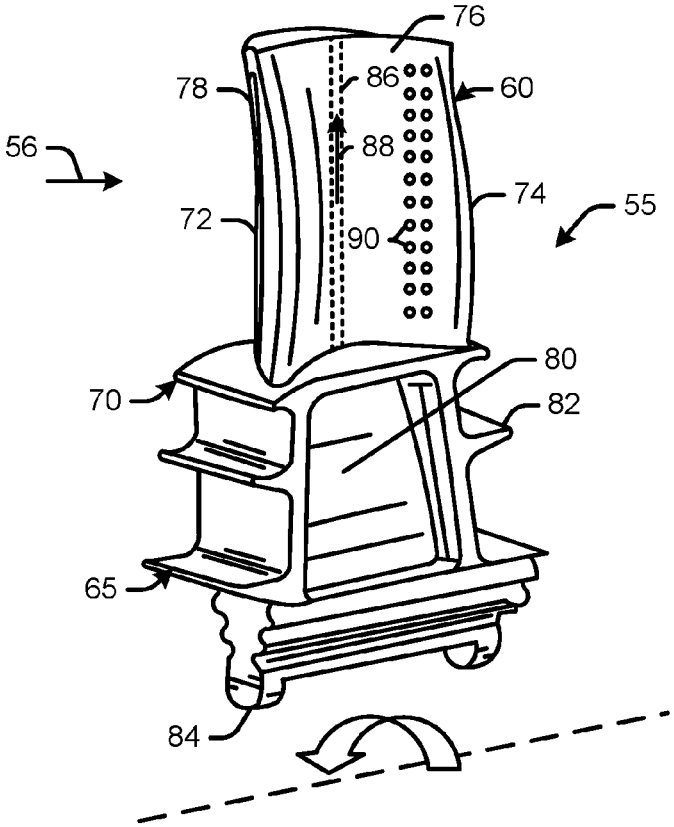
FIG. 2 (Prior Art)
FIG. 2 is a perspective view of an example of a known turbine component such as a turbine bucket.

FIG. 2 shows an example of a turbine bucket 55 that may be used in a hot gas path 56 of the turbine 40 and the like. Generally described, the turbine bucket 55 may include an airfoil 60, a shank portion 65, and a platform 70 disposed between the airfoil 60 and the shank portion 65. The airfoil 60 generally extends radially upward from the platform 70 and includes a leading edge 72 and a trailing edge 74. The airfoil 60 also may include a concave surface defining a pressure side 76 and an opposite convex surface defining a suction side 78. The platform 70 may be substantially horizontal and planar. The shank portion 65 may extend radially downward from the platform 70 such that the platform 70 generally defines an interface between the airfoil 60 and the shank portion 65. The shank portion 65 may include a shank cavity 80 therein. The shank portion 65 also may include one or more angel wings 82 and a root structure 84 such as a dovetail and the like. The root structure 84 may be configured to secure the turbine bucket 55 to the shaft 45. Any number of the turbine buckets 55 may be circumferentially arranged about the shaft 45. Other components and other configurations also may be used herein.

The turbine bucket 55 may include one or more cooling circuits 86 extending therethrough for flowing a cooling medium 88 such as air from the compressor 15 or from another source. Steam and other types of cooling mediums 88 also may be used herein. The cooling circuits 86 and the cooling medium 88 may circulate at least through portions of the airfoil 60, the shank portion 65, and the platform 70 in any order, direction, or route. Many different types of cooling circuits and cooling mediums may be used herein in any orientation. The cooling circuits 86 may lead to a number of cooling holes 90 or other types of cooling pathways for film cooling about the airfoil 60 or elsewhere. Other types of cooling methods may be used. Other components and other configurations also may be used herein.

Figure 3:
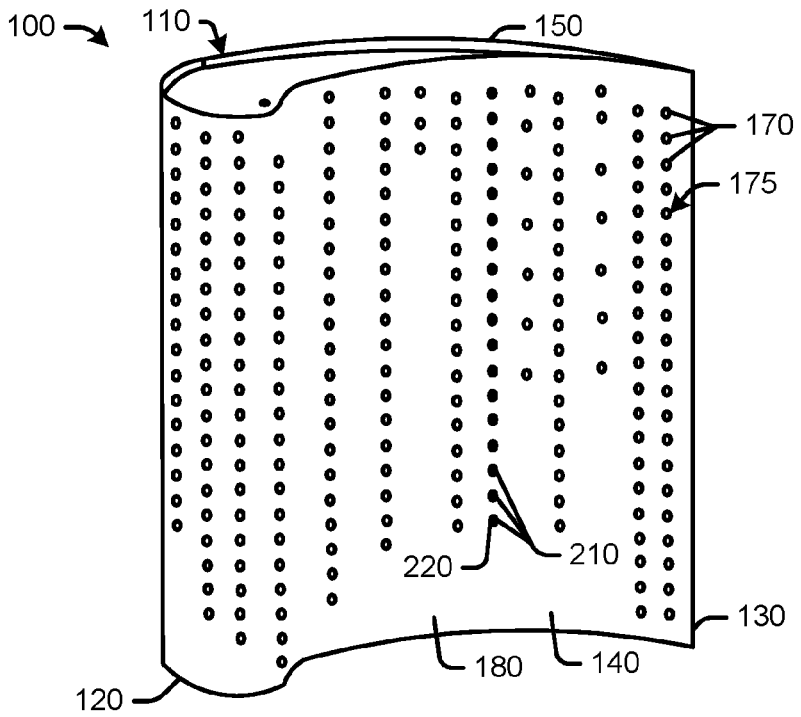
FIG. 3 is a perspective view of a portion of a turbine component as may be described herein.

FIG. 3 shows an example of a portion of a turbine component 100 as may be described herein. In this example, the turbine component 100 may be an airfoil 110 and more particularly a sidewall thereof. The airfoil 110 may be a part of a blade or a vane and the like. The turbine component 100 also may be any type of air-cooled component including a shank, a platform, or any type of hot gas path component. Other types of components and other configurations may be used herein.

Similar to that described above, the airfoil 110 may include a leading edge 120 and a trailing edge 130. Likewise, the airfoil 110 may include a pressure side 140 and a suction side 150. The airfoil 110 also may include one or more internal cooling circuits 160 therein. The cooling circuits 160 may lead to a number of cooling pathways 170 such as a number of cooling holes 175. The cooling holes 175 may extend through an outer surface 180 of the airfoil 110 or elsewhere. The cooling circuits 160 and the cooling holes 175 serve to cool the airfoil 110 and the components thereof with a cooling medium 190 therein. Any type of cooling medium 190, such air, steam, and the like, may be used herein from any source. The cooling holes 175 may have any size, shape, or configuration. Any number of the cooling holes 175 may be used herein. Other types of cooling pathways 170 may be used herein. Other components and other configurations may be used herein.

Figure 4:
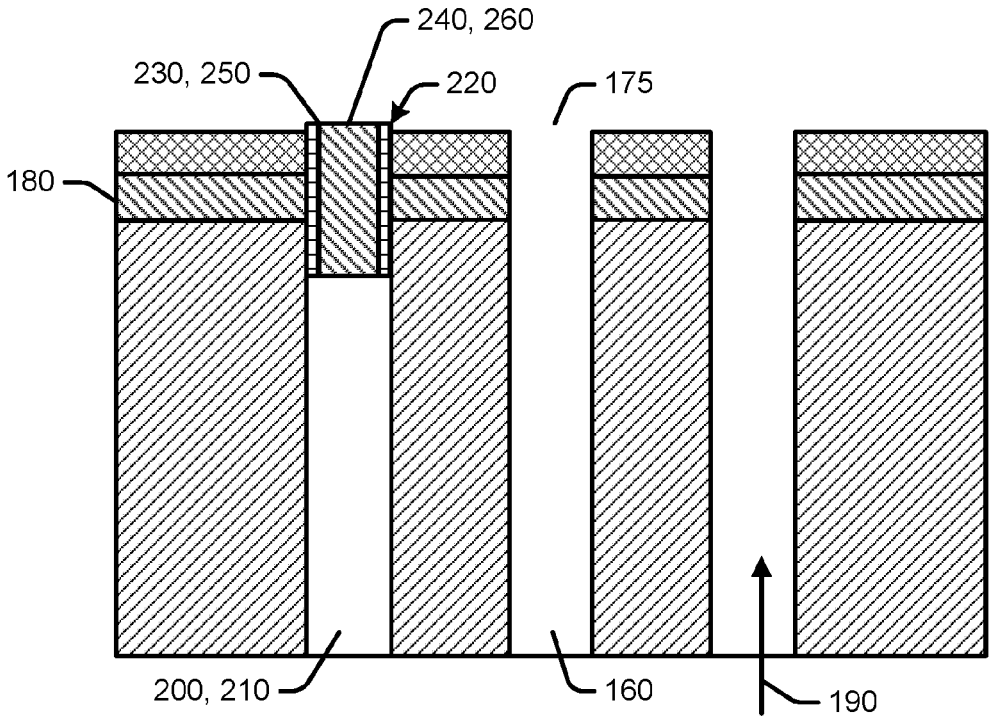
FIG. 4 is a side cross-sectional view of a portion of the turbine component of FIG. 3 with a bi-material cooling hole plug within an adaptive cooling pathway as may be described herein.
Figure 5:
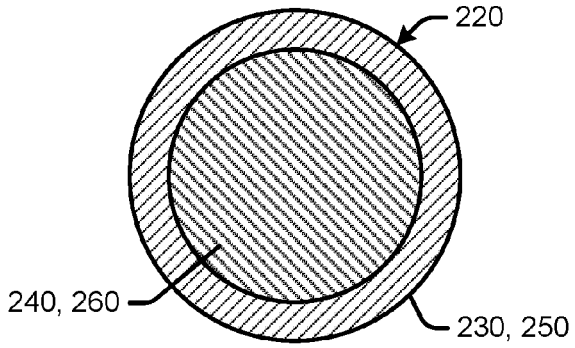
FIG. 5 is a cross-sectional view of the bi-material cooling hole plug of FIG. 4.
Figure 6:
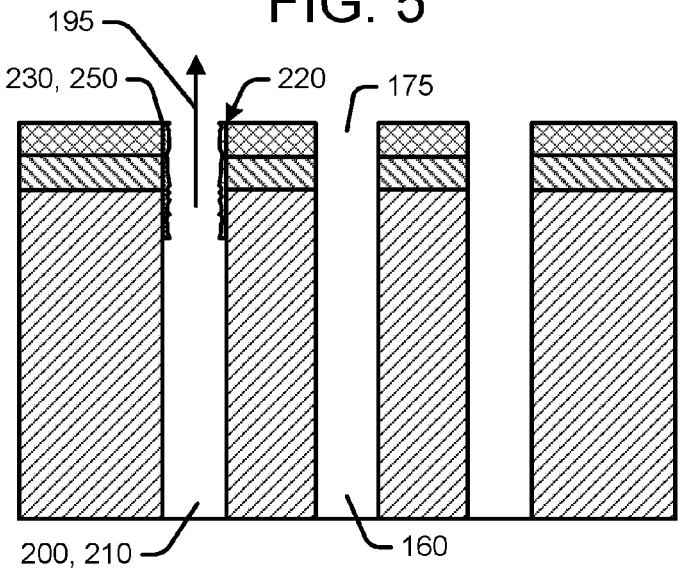
FIG. 6 is a side cross-sectional view of a portion of the turbine component of FIG. 3 with the higher temperature inner material of the bi-material cooling hole plug released.

As is shown in FIG. 4, the airfoil 110 also may include a number of adaptive cooling pathways 200. In this example, the adaptive cooling pathways 200 may be in the form of a number of adaptive cooling holes 210. The adaptive cooling holes 210 may extend through the outer surface 180 in a manner similar to the cooling holes 175. The adaptive cooling holes 210 also may be in communication with one or more of the cooling circuits 160. The adaptive cooling holes 210 may be filled with a bi-material cooling plug 220. As is shown in FIGS. 4 and 5, the bi-material cooling plug 220 may include two or more materials with different melting points to fill and plug the cooling holes 210. Although the bi-material cooling plug 220 may use two different metals, any two different materials may be used herein. Moreover, the two or more materials maintain their respective properties, i.e., an alloy and the like is not created herein. Rather, an alloy may be one or more of the two or more materials used herein.

Specifically, the bi-material cooling plug 220 may include a lower temperature outer material 230 and a higher temperature inner material 240. The terms "lower" and "higher" are used in their relative sense with respect to each other. Materials of any melting or release temperatures may be used herein. The lower temperature outer material 230 may be a low temperature braze material and the like. By way of example, the lower temperature outer material 230 may soften and melt in a manner similar to glass, turn to ash or otherwise oxidize, and/or change volumetrically at a low predetermined temperature 250. In this example, the low predetermined temperature may be about 900 to about 1900 degrees Fahrenheit (about 482 to about 1038 degrees Celsius). Other predetermined temperatures may be used herein. Examples of the lower temperature outer material 230 may include AMS 4764 and other types of copper-based brazing fillers. Such a material may have about a solidus-liquidus temperature of about 1600 to about 1700 degree Fahrenheit (about 871 to about 927 degrees Celsius). Other types of materials may be used herein.

The higher temperature inner material 240 may include a high predetermined temperature 260. The high predetermined temperature in this example may be about 1901 to about 2400 degrees Fahrenheit (about 1038 to about 1316 degrees Celsius). Other high predetermined temperatures 260 may be used herein. The higher temperature inner material 240 may be a high temperature braze material and the like. Examples of the higher temperature inner material 240 may include AMS 4779 and other types of nickel-alloy based brazing fillers. Such a material may have about a solidus-liquidus temperature of about 1800 to about 1900 degree Fahrenheit (about 982 to about 1038 degrees Celsius) (although the melt out may be beyond these temperatures). Other types of materials may be used herein.

In use, the cooling holes 170, 210 may be drilled or otherwise inserted into the turbine component 100. The turbine component 100 may be coated with a conventional thermal barrier coating and the like. The adaptive cooling holes 210 may be filled with the bi-material cooling plugs 220. Specifically, the lower temperature outer material 230 of the bi-material cooling plug 220 may be joined to the cooling hole 210 with the higher temperature inner material 240 therein.

If the surface temperature of any area of the turbine component 100 reaches or exceeds the design temperature from, for example, a hot spot, the lower temperature outer material 230 of the bi-material cooling plug 220 may melt, burn, or otherwise release once the low predetermined temperature 250 is reached or exceeded. Once the integrity of the lower temperature outer material 230 is compromised, high pressures within the turbine component 100 may force the remaining higher temperature inner material 240 out of the cooling hole 210. Removal of the bi-material cooling plug 220 thus opens the adaptive cooling hole 210 and provides a cooling feature in a region requiring such a cooling flow. FIG. 5 shows the adaptive cooling hole 210 once the bi-material cooling plug 220 has been released. Only a thin layer of the lower temperature outer material 230 may remain. Once the bi-material cooling plug 220 has been released, the supplemental volume 195 of the cooling medium 190 may be used to cool the component 100. Such a supplemental volume 195 of the cooling medium 190 may mitigate localized problems such as spallation and oxidation or other deleterious high temperature effects.

The bi-material cooling plug 220 thus allows for extra cooling if the localized surface temperature of the turbine component 100 exceeds the design temperature such as where a hot spot occurs. Similarly, the bi-material cooling plug 220 may act as an overall design failsafe. The bi-material cooling plug 220 provides extra cooling exactly where needed as opposed to relying on predictive models or simulations. Rather, this cooling strategy adapts to the actual operating conditions of the gas turbine engine 10 and the specific turbine component 100. Given such, overall engine testing may be reduced. Because the bi-material cooling plugs 220 may only be opened once the local temperature reaches the point when cooling air is needed, the bi-material cooling plug 220 provides a passively adaptive or "self-healing" thermal design. If predicted hot spots are in fact hot, the bi-material cooling plugs 220 may open. If not, the bi-material cooling plugs 220 may stay closed. Given such, lower cooling flows may be provided at higher firing temperatures with lower component risk and/or outages. The overall amount of cooling flow therefore may be decreased. Moreover, the bi-material cooling plug 220 may have benefits over single material plugs in that such single material plugs tend to form pin-hole leaks in the center thereof so as to prevent the desired amount of cooling flow therethrough.

Figure 7:
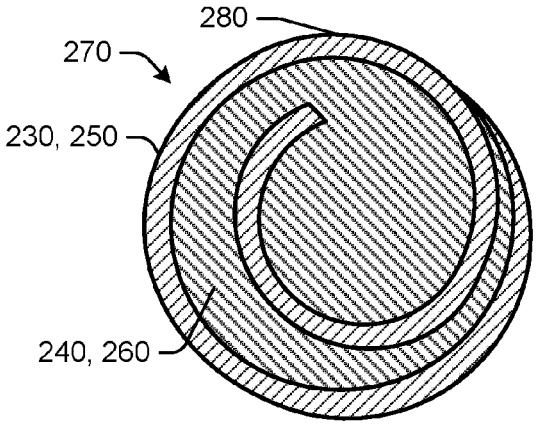
FIG. 7 is a side cross-sectional view of an alternative embodiment of a bi-material cooling hole plug as may be described herein.

FIG. 7 shows an alternative embodiment of a bi-material cooling plug 270 as may be described herein. In this example, instead of the lower temperature outer material 230 encircling the higher temperature inner material 240, the respective materials 230, 240 are instead rolled into a swirled configuration 280. The lower temperature outer material 230 again may be joined to the cooling hole 210 and may melt or otherwise dissipate or release when the low predetermined temperature 250 is reached or exceeded. The lower temperature outer material 230 also extends within the higher temperature inner material 240 so as to promote removal of the higher temperature inner material 240 with respect to the internal high pressures. Other components and other configurations may be used herein.

The adaptive cooling pathways 200 also allow for a minimized use of the cooling medium 190. Specifically, the adaptive cooling pathways 200 may be opened for the supplemental volume 195 of the cooling medium 190 only once the turbine component 100 or an area thereof reaches the predetermined low temperature. As such, the adaptive cooling pathways 200 may lead to a reduction in design time and a decrease in field variation. The overall lifetime of the turbine component 100 also should be increased. Specifically, the number of intervals that the component 100 may operate may be increased. Likewise, the amount of the cooling medium 190 may be reduced in that only the required adaptive cooling pathways 200 may be opened for the supplemental volume 195 of the cooling medium 190. Moreover, new cooling strategies may be employed given the lack of concern with overheating.

Figure 8:
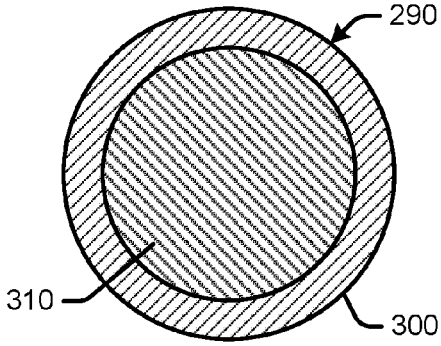
FIG. 8 is a side-cross-sectional view of an alternative embodiment of a bi-material cooling hole plug as may be described herein.

FIG. 8 shows an alternative embodiment of a bi-material cooling plug 290 as may be described herein. In this example, instead of the lower temperature outer material 230 encircling the higher temperature inner material 240, the position of the respective materials 230, 240 may be reversed. Given such, the bi-material cooling plug 290 may have a higher temperature outer material 300 surrounding a lower temperature inner material 310. The lower temperature inner material 310 may melt or otherwise dissipate or release when the low predetermined temperature 250 is reached or exceeded. Loss of the lower temperature inner material 310 thus may create a variable diameter cooling hole based upon the local temperature and other parameters. The diameter of the cooling holes may vary herein. The bi-material cooling plug 290 thus provides an increase in in-situ tenability (i.e., cold melt on inside) and the complete removal of the plug (i.e., cold melt on outside). Other components and other configurations may be used herein.

It should be apparent that the foregoing relates only to certain embodiments of the present application and the resultant patent. Numerous changes and modifications may be made herein by one of ordinary skill in the art without departing from the general spirit and scope of the invention as defined by the following claims and the equivalents thereof.

We claim:

1. A turbine component for use in a hot gas path of a gas turbine engine, comprising:

an outer surface;

an internal cooling circuit;

an adaptive cooling pathway in communication with the internal cooling circuit and extending through the outer surface; and a cooling plug positioned within the adaptive cooling pathway, wherein the cooling plug comprises a first material and a second material, wherein the first material comprises a lower predetermined melting temperature than the second material, wherein the first material and the second material comprise a swirled configuration.

2. A method of cooling a turbine component operating in a hot gas path, comprising:

positioning an adaptive cooling pathway in communication with an internal cooling circuit through an outer surface of the turbine component;

positioning a multi-material cooling plug in the adaptive cooling pathway, wherein the multi-material cooling plug comprises an outer material comprising a tubular casing surrounding a solid inner material, wherein the outer material is disposed around a circumference of the inner material, wherein the outer material is disposed between the inner material and a wall of the adaptive cooling pathway, wherein the outer material is not disposed on a surface of the inner material facing away from the adaptive cooling pathway, wherein the outer material comprises a lower predetermined melting temperature than the inner material;

releasing the multi-material cooling plug if a predetermined temperature of the outer material of the multi-material cooling plug is reached or exceeded; and flowing a cooling medium through the adaptive cooling pathway to cool a localized portion of the outer surface.

* * * * *